US008668512B2

(12) United States Patent
Chang

(10) Patent No.: US 8,668,512 B2
(45) Date of Patent: Mar. 11, 2014

(54) SAFETY SOCKET

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 9 days.

(21) Appl. No.: 13/628,416

(22) Filed: Sep. 27, 2012

(65) Prior Publication Data

US 2013/0109213 A1 May 2, 2013

(30) Foreign Application Priority Data

Sep. 30, 2011 (TW) ..... 100218389 U

(51) Int. Cl.
*H01R 13/62* (2006.01)

(52) U.S. Cl.
USPC ..... 439/304

(58) Field of Classification Search
USPC ..... 439/304, 346, 145, 188, 137, 140, 347, 439/134–135
See application file for complete search history.

(56) References Cited

U.S. PATENT DOCUMENTS

| | | | | |
|---|---|---|---|---|
| 5,964,598 | A * | 10/1999 | Gonzales | 439/133 |
| 6,049,045 | A * | 4/2000 | Becker et al. | 200/51 R |
| 7,080,889 | B2 * | 7/2006 | Ling et al. | 200/334 |
| 8,105,094 | B2 * | 1/2012 | Patel et al. | 439/76.1 |
| 8,152,554 | B2 * | 4/2012 | Chapel et al. | 439/346 |
| 8,435,055 | B1 * | 5/2013 | Bhosale | 439/145 |
| 8,545,251 | B2 * | 10/2013 | Gordon et al. | 439/346 |

* cited by examiner

*Primary Examiner* — Jean F Duverne

(57) ABSTRACT

A safety socket of the present invention has one or several groups of socket holes, lock mechanisms, and release mechanisms. Plug can be inserted into the socket holes. The lock mechanism can engage the plug for preventing unexpected removal of the plug. The release mechanism is used for operating the lock mechanism for releasing the plug. The release mechanism has a button which is arranged at aside of the socket holes. Thus, the button would not be hidden by the plug. User can approach to the button easily. Operation condition of the safety socket is then facilitated.

13 Claims, 10 Drawing Sheets

SAFETY SOCKET

BACKGROUND OF THE INVENTION

1. Field of the Invention

The present invention relates to a safety socket which is able to prohibit unexpected removal of plug.

2. Description of the Prior Art

In conventional safety socket, some products are provided with a plate or flake accompanied with an opening The plate/flake can be pressed tilt so as to engage a plug with the opening. Thus, removal of the plug is prohibited. Such socket and technique is detailed described in prior patent GB2383202. In addition, TW utility model TWM285106 adopts the same technique to prevent removal of plug.

Besides, another restriction mechanism for preventing removal of plug is provided as described in U.S. Pat. No. 4,909,749. Safety of using the socket and the plug is also improved.

However, the socket provided in U.S. Pat. No. 4,909,749 is inconvenient in using. The buttons for removing or releasing plugs are arranged just above the groups of socket holes. When plugs are inserted in the groups of socket holes, the buttons would be hidden. User can hardly approach to the buttons for releasing plugs.

The present invention is, therefore, arisen to obviate or at least mitigate the above mentioned disadvantages.

SUMMARY OF THE INVENTION

The main object of the present invention is to provide a safety socket which has an approachable button or release mechanism for releasing locked plug.

To achieve the above and other objects, a safety socket of the present invention includes a housing, at least one lock mechanism, and at lease one release mechanism.

The housing has an upper surface. The housing is formed with at least a group of socket holes. The group of socket holes comprises plural socket holes. The group of socket holes is adapted for a corresponding plug to insert therein. The plug has at least two conductive pins each of which is able to insert into one of the socket holes.

The lock mechanism is disposed beneath the upper surface. The lock mechanism is arranged with one of the socket holes. The lock mechanism is adapted for switching between a lock position and a release position. The lock mechanism engages the conductive pin which inserts into the socket hole corresponding to the lock mechanism when the lock mechanism is located at the lock position, so that the plug is unable to be removed from the socket holes. The plug is able to insert into and escape from the socket holes arbitrarily when the lock mechanism is located at the release position.

The release mechanism is motionably disposed on the housing. The release mechanism and the lock mechanism achieve an operational relationship, so that the release mechanism is able to drive the lock mechanism toward the release position. The release mechanism has a button. The button protrudes upon the upper surface. The button is arranged at one side of the group of socket holes.

In some possible cases, one socket hole and a remote socket hole of the group of socket holes are arranged laterally and extend vertically. The button is arranged out of the region defined between the socket holes remote from each other from a front view.

In other possible cases, a fictitious rectangular region is defined on the upper surface. The rectangular region is minimized to just enclosing the group of socket holes. The rectangular region has two short sides which are arranged laterally. The button is arranged out of the short sides from a front view.

In the other possible cases, the housing is formed with plural groups of socket holes. The safety socket comprises plural lock mechanisms and plural release mechanisms to correspond to the groups of socket holes. The groups of socket holes are arranged vertically. The release mechanisms have buttons which are laterally arranged beside the groups of socket holes.

As such, the safety socket of the present invention is suitable for connecting with a plug. The lock mechanism would engage and lock the plug once the plug is inserted into the socket holes. Unexpected removal of the plug is prohibited. When user intends to remove the plug, user can press the button of the release mechanism down, and the lock mechanism would then release the plug. The button is located aside of the socket holes. Thus, user can approach to the button easily.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
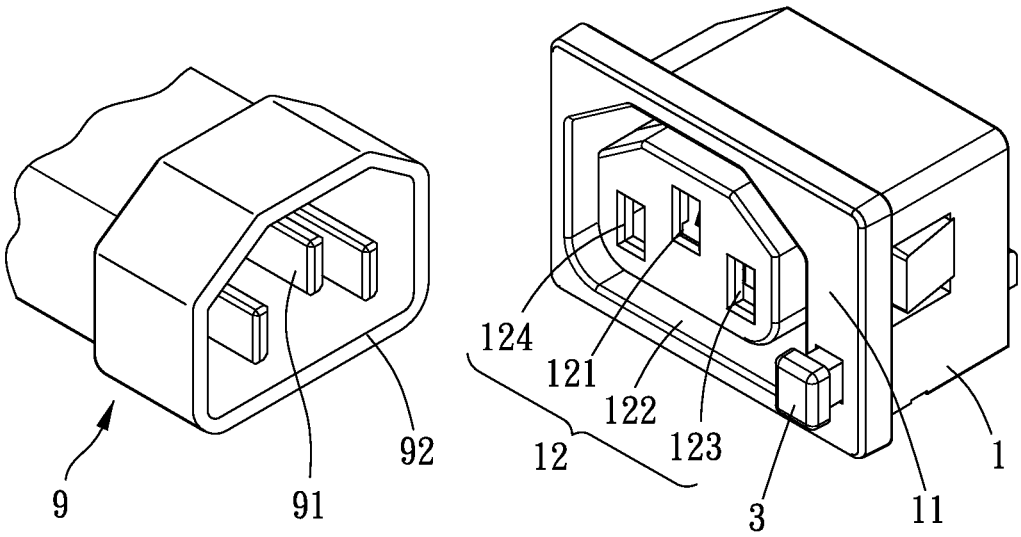
FIG. 1 is a stereogram showing a first embodiment of the present invention.
Figure 2:
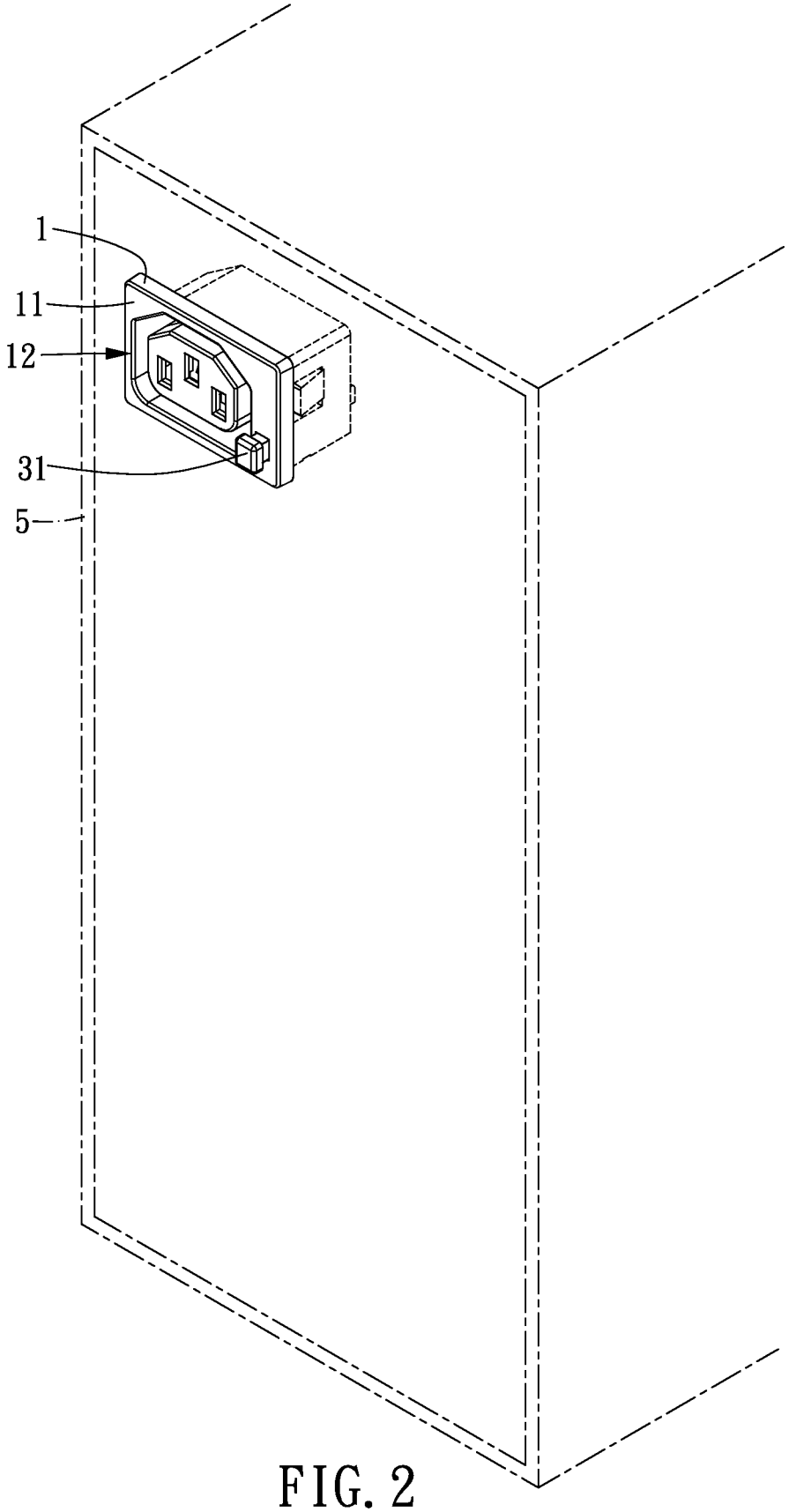
FIG. 2 is a schematic drawing showing a mainframe attached with a safety socket of the present invention.

Please refer to FIG. 1 and FIG. 2 for a first embodiment of the present invention. The safety socket is provided for a plug 9 to be inserted therein. The plug 9 includes at lease two conductive pins 91 which are made of metal and formed as plates. In the present embodiment, the plug includes three conductive pins 91 and a hexagonal shell 92. The safety socket is suitable for mainframe or server. Please refer to FIG. 1 to FIG. 5. The safety socket includes a housing 1, a lock mechanism 2, and a release mechanism 3. Preferably, a restrain mechanism 4 is also included in.

Figure 3:
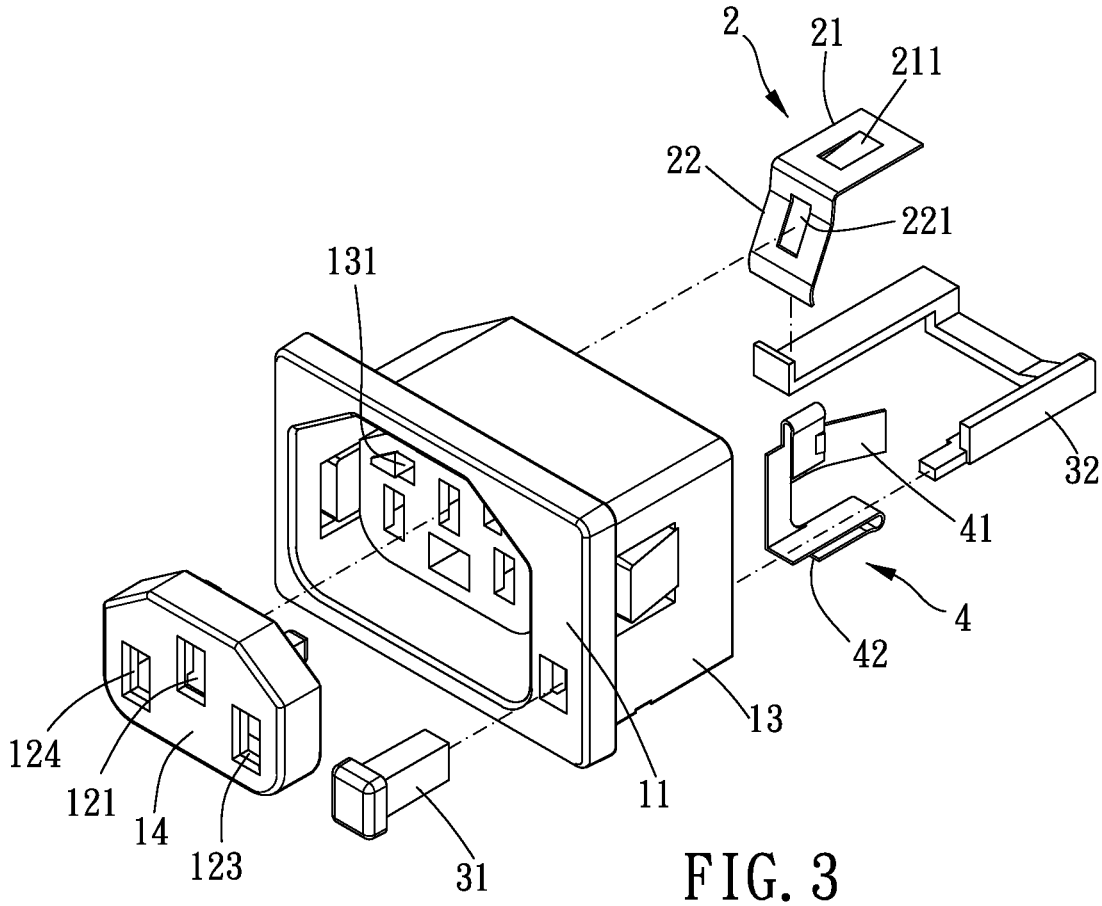
FIG. 3 is a break down drawing showing a first embodiment of the present invention.
Figure 3A:
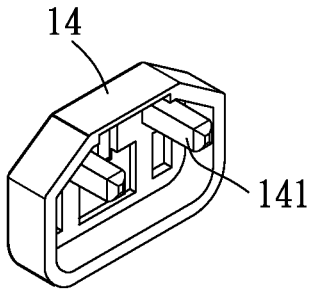
FIG. 3A is a stereogram showing an inner housing of a first embodiment of the present invention.

The housing 1 has an upper surface 11. The housing 1 is formed with a group of socket holes 12 including plural socket holes 121, 122, 123, and 124 which are adapted for the plug 9 to insert therein. The conductive pins 91 can insert in the socket holes respectively. Corresponding to appearance of the plug 9, the group of socket holes includes one socket hole 122 which are stretched as a hexagonal annular ditch. The other socket holes 121, 123, and 124 are enclosed by the hexagonal socket hole 122. Thus, the hexagonal shell 92 of the plug 9 can be inserted into the corresponding hexagonal socket hole 122. In the present embodiment, the housing 1 is assembled from an outer housing 13 and an inner housing 14. For fixation purpose, the outer housing 13 is formed with fixation holes 131 which are adapted for the inner housing 14 to insert therein. Correspondingly, as shown in FIG. 3A, the inner housing 14 is formed with fixation poles 141.

Figure 4:
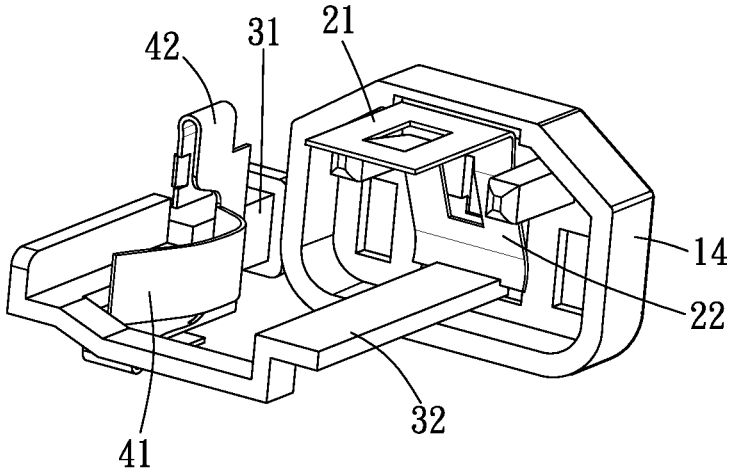
FIG. 4 is a combination drawing showing partial components of a first embodiment of the present invention.

The lock mechanism 2 is disposed beneath the upper surface 11, being arranged with one socket hole 121. The lock mechanism 2 can be switched between a lock position and a release position. More particularly, the lock mechanism includes an engagement plate which is preferably made of metal. The engagement plate has a fix section 21 and an engage section 22. The fix section 21 is formed with corresponding groove and mounting plate 211 which are provided for being mounted on the housing 1. Thus, the fix section 21 is mounted to the housing 1. The engage section 22 stretches out from one end of the fix section 21. The engage section 22 is tilted with respect to the fix section 21. The engage section 22 extends forward and is positioned between the inner housing 14 and the outer housing 13, as shown in FIG. 4. The engage section 22 has an opening 221 which is lined up with the socket hole 121. The engage section 22 is bendable with respect to the fix section 21. Please refer to FIG. 9 and FIG. 10. When the lock mechanism 2 is switched toward the release position, the engage section 22 is bent to sway toward the upper surface 11 and is substantially parallel to the upper surface 11. The phrase substantially parallel taken here means that an angle defined by the upper surface 11 and the engage section 22 is narrowed or that the engage section 22 is parallel to the upper surface 11 after the lock mechanism is switched toward the release position. In other words, the engage section 22 is not necessarily parallel to the upper surface 11. The engage section 22 and the fix section 21 of the engagement plate have elasticity. Thus, when the engage section 22 is bent toward the upper surface 11, the engage section 22 bears elastic force exerted backward provided by the engagement plate. Therefore, the lock mechanism 2 has a tendency to return to the lock position automatically.

The release mechanism 3 is motionably disposed on the housing 1. The release mechanism 3 and the lock mechanism 2 achieve an operational relationship, so that the release mechanism 3 is able to drive the lock mechanism 2 toward the release position. More particularly, the release mechanism 3 includes a button 31 and a linkage 32. The button 31 protrudes vertically upon the upper surface 11. The button 31 is arranged at one side of the group of socket holes 12, so that user can approach the button easily even the plug is inserted into the socket holes. When the button 31 is pressed down, the button 31 pushes and drives the linkage 32 to move. The linkage 32 grasps at the distal end of the engage section 22, so that the engage section 22 is bent to sway when the linkage 32 moves. The lock mechanism is then switched to the release position. Preferably, the button 31 and the linkage 32 are slidably disposed on the housing 1. A slide direction defined by the release mechanism is perpendicular to the upper surface 11. In addition, the linkage 32 is formed with an abutting surface at one side. In other possible embodiments of the present invention, the button 31 may press on, be mounted to, be engaged to, or be attached to the linkage 32.

Figure 5:
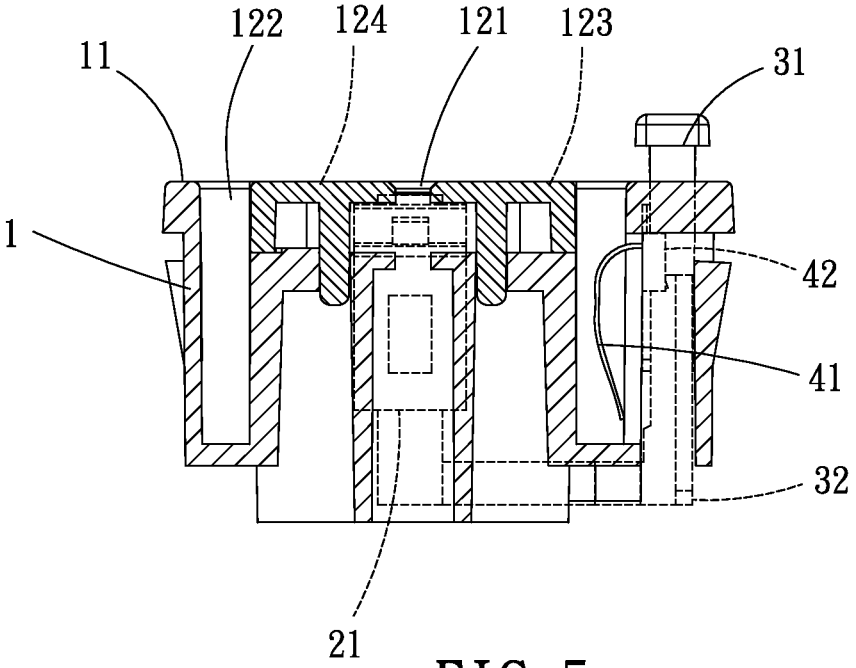
FIG. 5 is a profile showing a second embodiment of the present invention.

The button 31 of the release mechanism and the socket holes 121, 122, 123, and 124 are all located on the upper surface. The button 31 is arranged at one side of the group of socket holes. More specifically, one socket hole 123 and the remote socket hole 124 of the group of socket holes are arranged laterally and extend vertically. In other words, the socket holes 123, 124 which are remote from each other are lengthened vertically and arranged laterally. As shown in FIG. 1 and FIG. 5, the button 31 is arranged out of the region defined between the socket holes 123, 124 from a front view.

Figure 6:
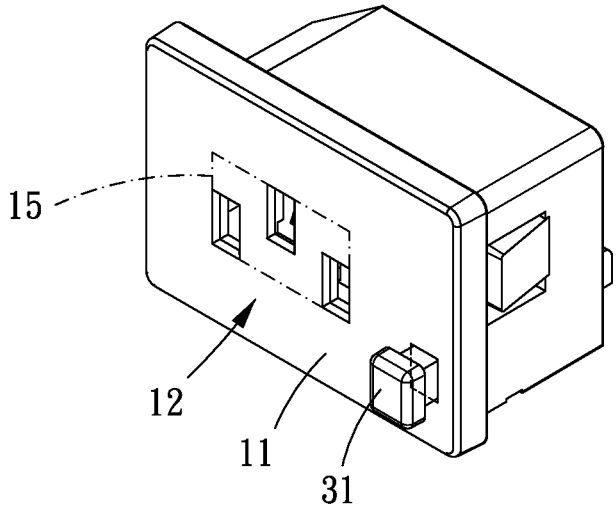
FIG. 6 is a stereogram showing a second embodiment of the present invention.
Figure 7:
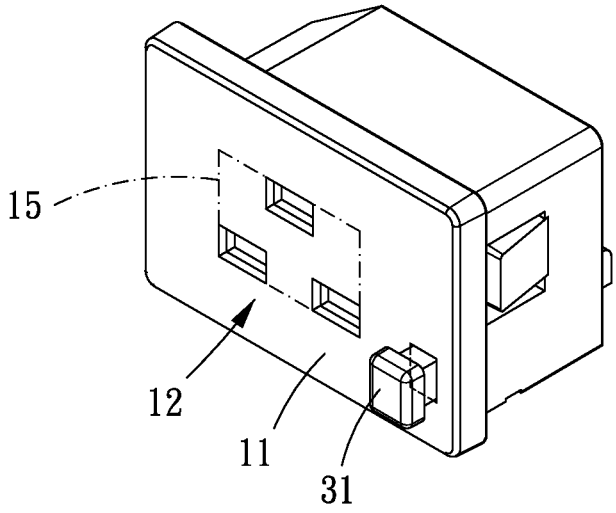
FIG. 7 is a stereogram showing a third embodiment of the present invention.

Even though the group of socket holes 12 may be lengthened and arranged with different patterns, location of the button 31 can still be described as follows. Please refer to FIG. 6 and FIG. 7. A fictitious rectangular region 15 is defined on the upper surface 11. The rectangular region 15 is minimized to just enclosing the group of socket holes 12. The rectangular region 15 has two short sides which are arranged laterally. The button 31 is arranged out of the short sides from a front view. In other words, the button 31 is located laterally out of the short sides of the rectangular region 15.

Figure 8:
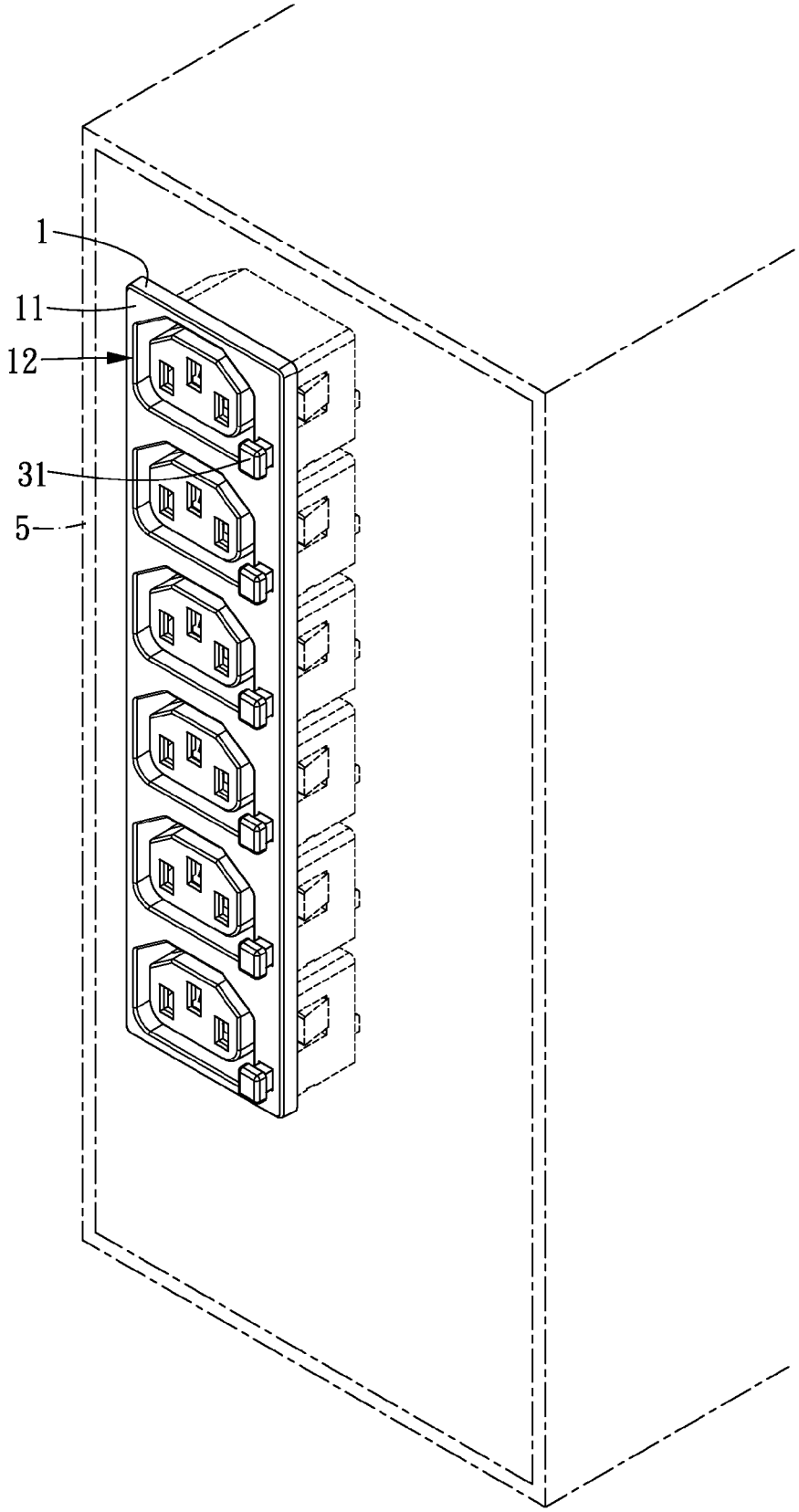
FIG. 8 is a stereogram showing a fourth embodiment of the present invention.

Please refer to FIG. 8. In the fourth embodiment of the present invention, the housing 1 may be formed with plural groups of socket holes 12. Correspondingly and respectively, plural lock mechanisms, release mechanisms, and restrain mechanisms are provided in the safety socket. Such safety socket is suitable for mainframe and server 5. In the embodiment, the groups of socket holes 12 are lined vertically up, and the buttons 31 of the release mechanisms are laterally arranged beside the groups of socket holes 12.

Please refer to FIG. 1 to FIG. 5. The restrain mechanism 4 is located between the release mechanism 3 and one socket hole 122. When the plug 9 inserts in the socket holes 121, 122, the restrain mechanism 4 abuts against the release mechanism 3. Motions of the release mechanism 3 and the lock mechanism are then resisted. Thus, the lock mechanism is unable to return to the lock position arbitrarily. More particularly, the restrain mechanism may be made of metal or other suitable material. The restrain mechanism 4 has an elastic member 41 and a positioning portion 42. The positioning portion 42 is a curved or folded plate which is mounted to the housing 1. The elastic member 41 is a curved elastic plate which stretches out from the positioning portion 42. A distal end of the elastic member 41 stretches away from the upper surface 11. Preferably, the elastic member 41 stretches perpendicularly from the positioning portion 42. That is to say, a connection portion of the elastic member 41 which is connected to the positioning portion 42 is perpendicular to the positioning portion 42. The elastic member 41 is partially located in the socket hole 122 which corresponds to the restrain mechanism. The socket hole 122 is adapted for the shell 92 to insert therein. When the plug 9 is inserted into the socket holes, the elastic member 41 is pressed by the plug 9 and moves from a slack position to a restrain position. The elastic member 41 has a tendency to recover to the slack position.

Accordingly, as shown in FIG. 9 to FIG. 13, the safety socket co-operated with the plug 9 is provided with safety and convenience effects.

Figure 9:
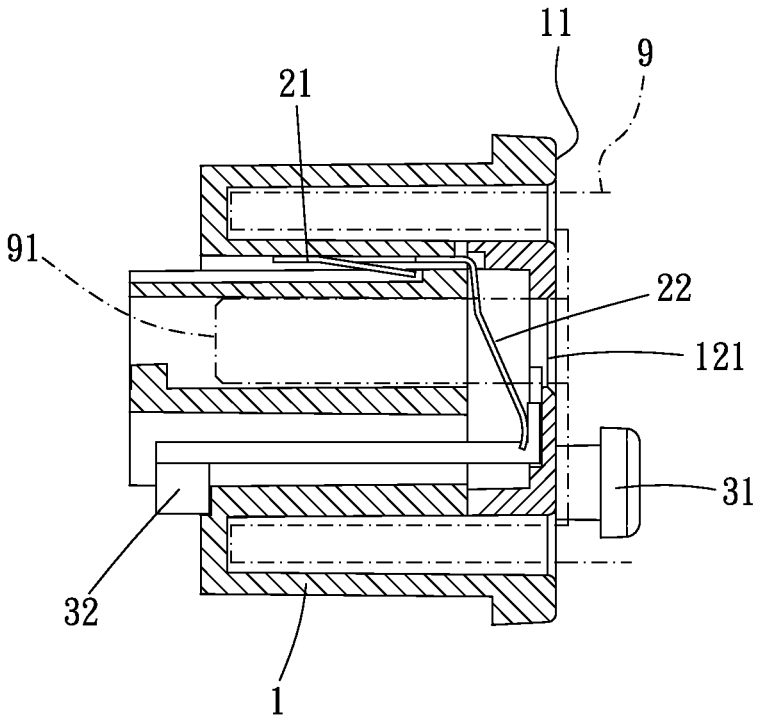
FIGS. 9 and 10 are profiles from a lateral viewpoint showing an operation condition of a first embodiment of the present invention.
Figure 11:
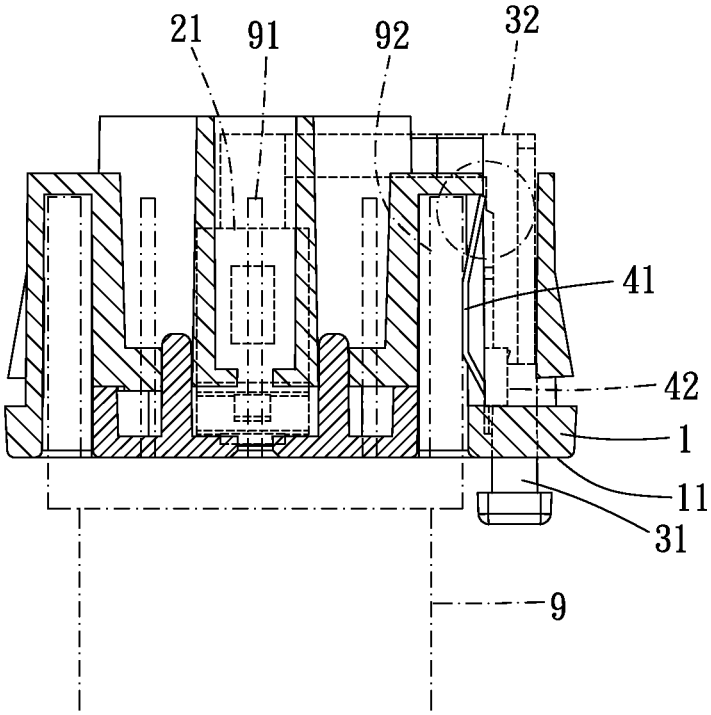
FIGS. 11, 12, and 13 are profiles from a vertical viewpoint showing an operation condition of a first embodiment of the present invention.

For safety purpose, as shown in FIG. 9 and FIG. 11, after the plug 9 is inserted into the safety socket, the lock mechanism is located at the lock position. The engage section 22 engages the conductive pin 91 which is inserted into the socket hole corresponded to the lock mechanism. The conductive pin 91 inserts into the opening of the engage section 22. The engage section 22 is driven by elastic force and tilted to the upper surface 11. Thus, a periphery edge of the opening clips the conductive pin 91. The plug 9 is then engaged and unable to be removed from the socket holes or the safety socket. Thus, unexpected or accidental removal of the plug 9 is prevented.

Figure 10:
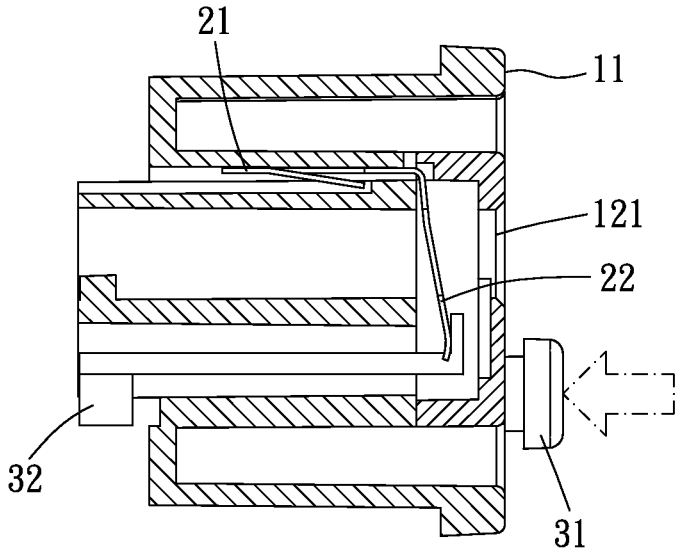
Figure 12:
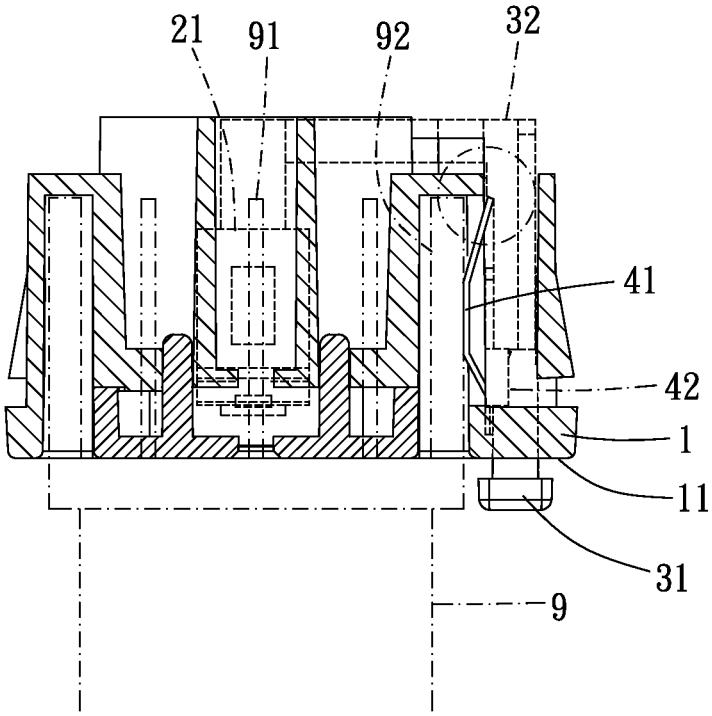

When user intends to remove the plug 9, as shown in FIG. 10 and FIG. 12, user can press the button 31 down. The button 31 is located aside of the socket holes without blind. User can approach the button 31 and operate the release mechanism and the lock mechanism easily.

Figure 11A:
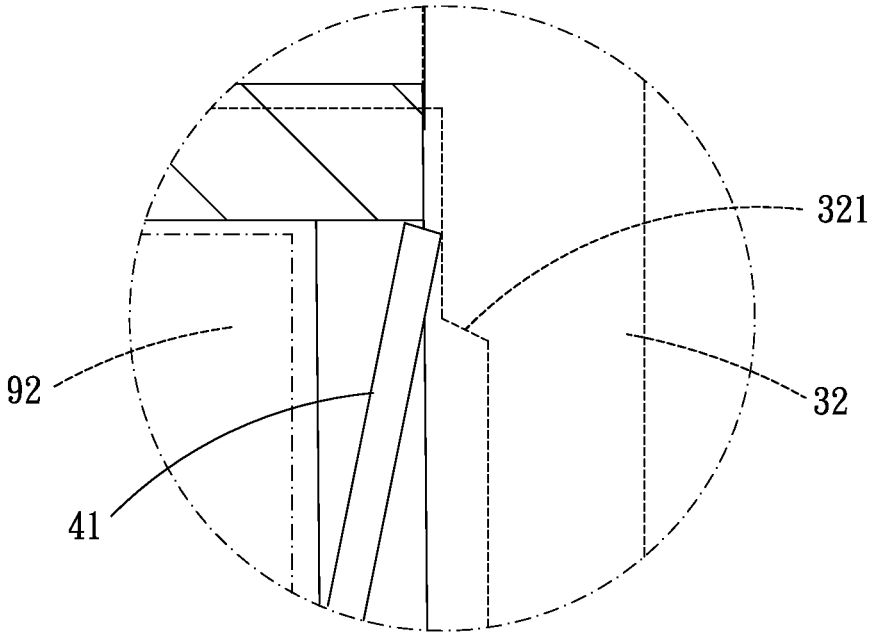
FIG. 11A is a partial enlargement drawing of FIG. 11.
Figure 12A:
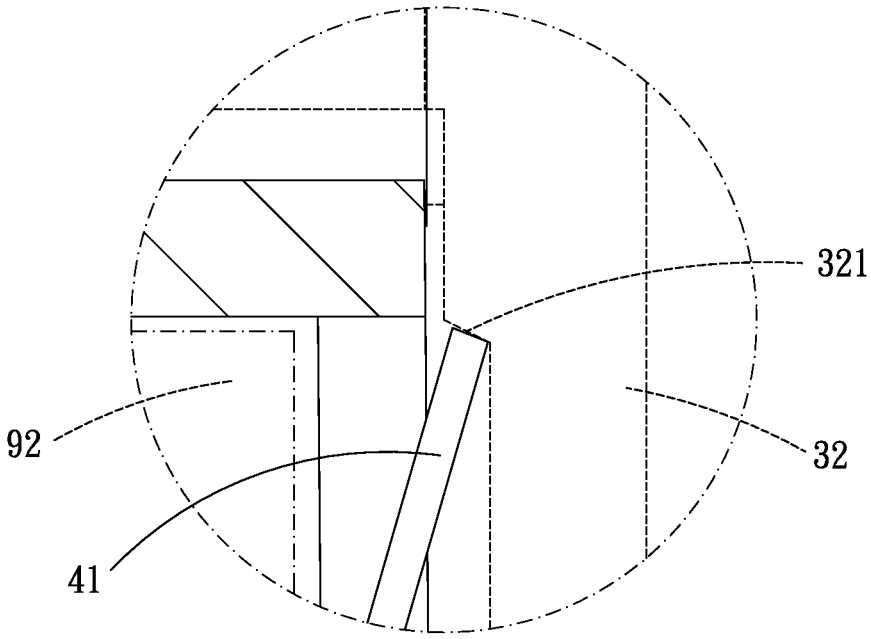
FIG. 12A is a partial enlargement drawing of FIG. 12.

After the plug 9 is inserted into the socket holes, the plug 9 presses against the elastic member 41 until the button 31 is pressed down and the plug is removed. As shown in FIG. 11, the elastic member 41 is forced to the restrain position and presses against the linkage 32 of the release mechanism. Please refer to FIG. 12. After the button is pressed down, the distal end of the elastic member 41 further abuts against the abutting surface 321 of the linkage 32, as shown in FIG. 11A and FIG. 12A. Thus, the elastic member 41 presses against and even engages the release mechanism, making the release mechanism unable to move arbitrarily. When user presses the button 31, the release mechanism is forced to move, taking the lock mechanism to the release position. Although the lock mechanism has a tendency to return to the lock position, the obstructed release mechanism is held in position by the elastic member, restraining and preventing recovery of the lock mechanism. In other words, once the button is pressed down, even though user may relinquish the button, the lock mechanism would be still unable to recover to engage the conductive pin 91 until the plug is removed. Without engagement, the conductive pin 91 can penetrate in and out arbitrarily.

In the present embodiment, the abutting surface 321 of the linkage 32 is tilted, facing the elastic member 41. Thus, motions of the elastic member 41 and the linkage 32 are smoothened. In other possible embodiments of the present invention, the abutting surface may be formed parallel to the upper surface, or the abutting surface may be dismissed without damaging function of the elastic member and the linkage.

Figure 13:
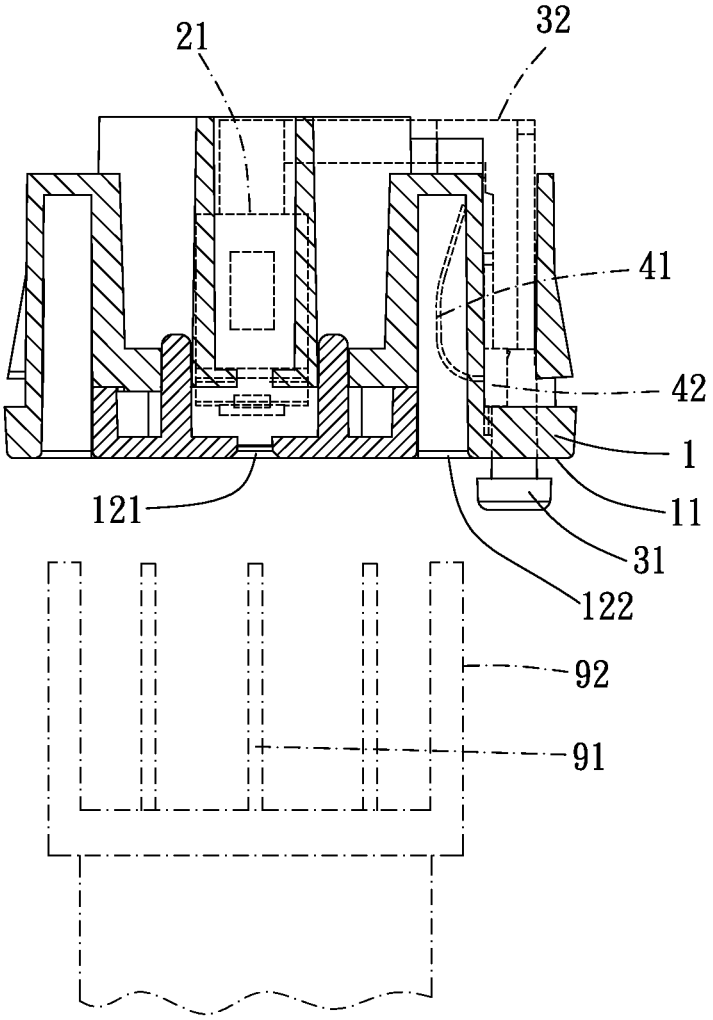

By the operation condition mentioned above, user can press down the button 31 with single hand, switching the lock mechanism to the release position, and pull and remove the plug 9 with the same single hand. As shown in FIG. 13, the plug 9 is then removed from the safety socket. The safety socket is single hand operable. Operation of the safety socket is facilitated.

Please refer to FIG. 10 and FIG. 13. When the plug 9 is removed form the socket holes 121, 122, the elastic member 41 is released and recovered to the slack position. The release mechanism and the lock mechanism are then released. The lock mechanism pushes the release mechanism and removes to the engage position automatically.

To conclude, by the structure described above, safety and conveniency of the safety socket is facilitated.

What is claimed is:

1. A safety socket, comprising:

a housing, having an upper surface, the housing being formed with at least a group of socket holes, the group of socket holes comprising plural socket holes, the group of socket holes being adapted for a corresponding plug to insert therein, the plug having at least two conductive pins each of which is able to insert into one of the socket holes;

at least a lock mechanism, disposed beneath the upper surface, the lock mechanism being arranged with one of the socket holes, the lock mechanism being adapted for switching between a lock position and a release position, the lock mechanism engaging the conductive pin which inserts into the socket hole corresponding to the lock mechanism when the lock mechanism is located at the lock position, so that the plug is unable to be removed from the socket holes, the plug being able to insert into and escape from the socket holes arbitrarily when the lock mechanism is located at the release position;

at least a release mechanism, motionably disposed on the housing, the release mechanism and the lock mechanism achieving an operational relationship, so that the release mechanism is able to drive the lock mechanism toward the release position, the release mechanism having a button, the button protruding upon the upper surface, the button being arranged at one side of the group of socket holes.

2. The safety socket of claim 1, wherein one socket hole and a remote socket hole of the group of socket holes are arranged laterally and extend vertically, the button is arranged out of the region defined between the socket holes remote from each other from a front view.

3. The safety socket of claim 1, wherein a fictitious rectangular region is defined on the upper surface, the rectangular region is minimized to just enclosing the group of socket holes, the rectangular region has two short sides which are arranged laterally, the button is arranged out of the short sides from a front view.

4. The safety socket of claim 1, wherein the housing is formed with plural groups of socket holes, the safety socket comprises plural lock mechanisms and plural release mechanisms to correspond to the groups of socket holes, the groups of socket holes are arranged vertically, the release mechanisms have buttons which are laterally arranged aside of the groups of socket holes.

5. The safety socket of claim 1, wherein the lock mechanism has a tendency to return to the lock position, the safety socket further comprises at least a restrain mechanism, the restrain mechanism is located between the release mechanism and one socket hole of the group of socket holes, the restrain mechanism abuts against the release mechanism when the plug inserts in the socket holes, so that motions of the release mechanism and the lock mechanism are resisted and the lock mechanism is unable to return to the lock position arbitrarily.

6. The safety socket of claim 5, wherein the restrain mechanism has an elastic member, the elastic member is partially located in the socket hole which corresponds to the restrain mechanism, the elastic member is driven by the plug and is able to move between a restrain position and a slack position, the elastic member presses against the release mechanism when the elastic member locates at the restrain position, so that a friction force is exerted on the elastic member and the release mechanism, the friction force restrains motion of the release mechanism, the elastic member does not press against the release mechanism when the elastic member locates at the slack position, so that motion of the release mechanism is not restrained by the elastic member, the elastic member has a tendency to recover to the slack position.

7. The safety socket of claim 6, wherein the release mechanism has an abutting surface, the elastic member presses against the abutting surface when the elastic member locates at the restrain position.

8. The safety socket of claim 7, wherein the abutting surface is tilted, facing the elastic member.

9. The safety socket of claim 6, wherein the elastic member is a curved elastic plate.

10. The safety socket of claim 9, wherein the restrain mechanism has a positioning portion, the elastic member stretches out from the positioning portion, and the positioning portion is mounted to the housing.

11. The safety socket of claim 10, wherein the elastic member stretches perpendicularly from the positioning portion, a distal end of the elastic member is away from the upper surface.

12. The safety socket of claim 1, wherein the release mechanism is slidably disposed on the housing, a slide direction defined by the release mechanism is perpendicular to the upper surface.

13. The safety socket of claim 1, wherein the lock mechanism comprises an engagement plate, the engagement plate has a fix section and an engage section, the fix section is mounted to the housing, the engage section stretches out from one end of the fix section, the engage section is tilted with respect to the fix section, the engage section has an opening, the opening is lined up with the socket hole which corresponds to the lock mechanism, the engage section is bendable with respect to the fix section, the engage section is bent substantially parallel to the upper surface when the lock mechanism is switched to the release position.

* * * * *